US007063243B2

(12) United States Patent
Forsman et al.

(10) Patent No.: US 7,063,243 B2
(45) **Date of Patent: *Jun. 20, 2006**

(54) HYDRATION SYSTEM WITH IMPROVED FLUID RESERVOIR

(75) Inventors: Barley A. Forsman, Cotati, CA (US); Robert Miros, Mill Valley, CA (US); Robert Choi, Rohnert Park, CA (US)

(73) Assignee: CamelBak Products, LLC, Petaluma, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/952,227

(22) Filed: Sep. 27, 2004

(65) Prior Publication Data

US 2005/0061840 A1 Mar. 24, 2005

Related U.S. Application Data

(63) Continuation of application No. 10/611,088, filed on Jun. 30, 2003, now Pat. No. 6,820,780, which is a continuation of application No. 09/902,935, filed on Jul. 10, 2001, now Pat. No. 6,675,998.

(51) Int. Cl.
*B65D 33/10* (2006.01)

(52) U.S. Cl. ..... 224/148.2; 215/306; 220/375; 220/705; 224/148.5; 383/80; 222/175; 222/467

(58) Field of Classification Search .. 224/146.1–146.6, 224/148.1, 148.2, 148.3, 148.4, 148.5, 148.6, 224/148.7; 220/212.5, 703, 705; 383/66, 383/80; 222/175, 467
See application file for complete search history.

(56) References Cited

U.S. PATENT DOCUMENTS

| | | | |
|---|---|---|---|
| 33,343 | A | 9/1861 | Garrick |
| 357,272 | A | 2/1887 | Donavin |
| 469,613 | A | 2/1892 | Vinyard |
| 581,767 | A | 5/1897 | Powers |
| 607,236 | A | 7/1898 | Hardman, Jr. |
| 619,712 | A | 2/1899 | Bartliff |

(Continued)

FOREIGN PATENT DOCUMENTS

DE 3727789 A1 3/1988

OTHER PUBLICATIONS

The CamelBak Narrow Gauge System advertisement, FasTrak Systems, Inc., 1996.

(Continued)

*Primary Examiner*—Stephen K. Cronin
*Assistant Examiner*—Justin M. Larson
(74) *Attorney, Agent, or Firm*—Kolisch Hartwell, P.C.

(57) ABSTRACT

Hydration systems with improved fluid reservoirs. The reservoirs include a fill port with a neck having an opening. The hydration systems further include a closure member, such as a cap, that selectively seals the opening, and an elongate drink tube through which a user may draw drink fluid from the reservoir. The hydration systems further include a wrench assembly that extends around the neck and includes handle that projects generally away from the neck. In some embodiments, the wrench assembly provides a counter lever to assist in the removal or coupling of the cap onto the neck. In some embodiments, the wrench assembly is removably mounted on the fill port, and in some embodiments, the wrench assembly is fixed secured to the fill port. In some embodiments, the wrench assembly is rotatably coupled to the fill port and in other the wrench assembly is non-rotatably coupled to the fill port.

52 Claims, 8 Drawing Sheets

U.S. PATENT DOCUMENTS 1,304,064 A 5/1919 Kearn
1,387,953 A 8/1921 Swift
1,619,120 A 3/1927 Heaton
1,637,635 A 8/1927 Corley
2,013,358 A 9/1935 Osborne
2,095,351 A 10/1937 Van Winkle
2,173,288 A 9/1939 Shapiro
2,213,057 A 8/1940 Sponsel
2,314,650 A 3/1943 Madsen
2,380,372 A 7/1945 Alderfer
2,412,544 A 12/1946 Waters
2,500,363 A 3/1950 Koeppel
2,610,081 A 9/1952 Bushman
2,687,158 A 8/1954 Owen
2,696,235 A 12/1954 Toffolon
2,738,907 A 3/1956 Lacher
2,757,814 A 8/1956 Schmitz
2,781,960 A 2/1957 Dick
2,802,608 A 8/1957 Gassaway
2,828,982 A 4/1958 Kennedy
2,829,386 A 4/1958 Peer
3,067,787 A 12/1962 Salk
3,087,491 A 4/1963 Gewecke et al.
3,137,898 A 6/1964 Geringer
3,138,293 A 6/1964 Roak et al.
3,160,304 A 12/1964 Peacock
3,168,887 A 2/1965 Bodell
3,233,777 A 2/1966 Farha
3,299,442 A 1/1967 White et al.
3,354,924 A 11/1967 Birrelle et al.
3,814,288 A 6/1974 Wetsrich
3,990,596 A 11/1976 Hoftman
4,089,447 A 5/1978 Achmeteli
4,090,650 A 5/1978 Gotta
4,095,812 A 6/1978 Rowe
4,139,130 A 2/1979 Glusker et al.
4,144,607 A 3/1979 Soubie
4,148,420 A 4/1979 Morrissette et al.
4,159,790 A 7/1979 Bailey
4,176,772 A 12/1979 Danon
4,189,075 A 2/1980 Hall
4,193,518 A 3/1980 Holmes
4,253,454 A 3/1981 Warncke
4,265,381 A 5/1981 Muscatell
4,274,566 A 6/1981 Rowe
4,335,770 A 6/1982 Kulle et al.
4,345,704 A 8/1982 Boughton
4,420,097 A 12/1983 Motsenbocker
4,449,654 A 5/1984 Cappis
4,526,298 A 7/1985 Boxer et al.
4,541,117 A 9/1985 Ashbeck
4,544,087 A 10/1985 Modig
4,629,098 A 12/1986 Eger
4,688,643 A 8/1987 Carter
4,699,298 A 10/1987 Grant
4,739,905 A 4/1988 Nelson
4,739,913 A 4/1988 Moore
4,758,099 A 7/1988 Branson
4,776,495 A 10/1988 Vignot
4,821,372 A 4/1989 Casiello
4,848,660 A 7/1989 O'Connell
4,852,781 A 8/1989 Shurnick et al.
4,941,598 A 7/1990 Lambelet, Jr. et al.
4,948,023 A 8/1990 Tripp
4,955,572 A 9/1990 Simmons
5,060,833 A 10/1991 Edison et al.
5,062,591 A 11/1991 Runkel
5,085,349 A 2/1992 Fawcett
5,104,016 A 4/1992 Runkel
5,114,059 A 5/1992 Thatcher
5,115,947 A 5/1992 McDonnell et al.
5,188,266 A 2/1993 Loulias
5,215,231 A 6/1993 Paczonay
D337,273 S 7/1993 Thatcher
D337,274 S 7/1993 Thatcher
5,228,609 A 7/1993 Gregory
5,230,566 A 7/1993 Jackson et al.
5,282,557 A 2/1994 McCook
5,301,858 A 4/1994 Hollander
5,320,240 A 6/1994 Wehle et al.
5,335,809 A 8/1994 Toida et al.
5,348,184 A 9/1994 Adams et al.
5,400,934 A 3/1995 Ducros
5,427,290 A 6/1995 Thatcher
5,431,308 A 7/1995 Tchen
5,437,387 A 8/1995 Burns
5,566,869 A 10/1996 Katz
5,573,135 A 11/1996 Stolzenfeld
5,573,152 A 11/1996 Arnold
5,577,647 A 11/1996 Pittarelli et al.
5,595,325 A 1/1997 Leres
5,601,207 A 2/1997 Paczonay
5,727,714 A 3/1998 Fawcett
5,730,336 A 3/1998 Lerner
5,755,368 A 5/1998 Bekkedahl
D396,630 S 8/1998 Lerner
5,791,510 A 8/1998 Paczonay
D398,776 S 9/1998 Fawcett
5,803,333 A 9/1998 Fawcett
5,806,726 A 9/1998 Ho
5,816,457 A 10/1998 Croft
5,938,095 A 8/1999 Haar et al.
6,032,831 A 3/2000 Gardner et al.
6,070,767 A 6/2000 Gardner et al.
6,076,967 A 6/2000 Beaudette
6,085,947 A 7/2000 Lien
6,138,853 A 10/2000 Frechette
6,247,619 B1 6/2001 Gill et al.
6,352,235 B1 3/2002 Cizek
6,644,854 B1 11/2003 Lien
6,675,998 B1 1/2004 Forsman et al.
6,820,780 B1 11/2004 Forsman et al.
2002/0193856 A1 12/2002 Lu
2005/0029313 A1 2/2005 Robins et al.

OTHER PUBLICATIONS

The Pakster advertisement, FasTrak Systems, Inc., 1996.
The HydroBak advertisement, FasTrak Systems, Inc., 1996.
The $H_2$•Flow advertisement, FasTrak Systems, Inc., 1996.
The MULE advertisement, FasTrak Systems, Inc., 1996.
CAMELBAK® Hydrate or Die® advertisement, FasTrak Systems, Inc., 1996.
CAMELBAK® Profit System Brochure, FasTrak Systems, Inc., Aug., 1996.

200
208
210
202
204
212
218
216
142
206
12'
218
126''
50
52
40''
122''
214
20
22
210

200
204
220
216
12
218
218
212

200
222
216
12
212

204
224
126'
40
46
224
122'
214
12

HYDRATION SYSTEM WITH IMPROVED FLUID RESERVOIR

RELATED APPLICATIONS

This application is a continuation of and claims priority to U.S. patent application Ser. No. 10/611,088, entitled "Neck-Supported Fluid Reservoir, Hydration Systems and Pack Assemblies Including the Same," which was filed on Jun. 30, 2003, issued Nov. 23, 2004 as U.S. Pat. No. 6,820,780, and which is a continuation of U.S. patent application Ser. No. 09/902,935, entitled "Hydration System With Improved Fluid Reservoir," which was filed on Jul. 10, 2001 and issued Jan. 13, 2004 as U.S. Pat. No. 6,675,998. The complete disclosures of the above-identified patent applications are hereby incorporated by reference for all purposes.

FIELD OF THE INVENTION

The present invention relates generally to hydration systems, and more particularly to a hydration system with an improved fluid reservoir.

BACKGROUND OF THE INVENTION

Medical research has demonstrated the importance of maintaining adequate hydration while engaging in strenuous physical activities, such as running, bicycling, hiking, or mountain climbing. In the not too distant past, participants in such activities carried their water in bottles or canteens from which they drank periodically. More recently, personal hydration systems have been developed which allow users to drink more or less continuously while engaged in sporting or recreational activities. These personal hydration systems typically have a bag-like fluid reservoir that is carried in a back- or waist-mounted pack. A long flexible tube is connected to the reservoir through an exit port at one end and terminates in a mouthpiece at the other end. The tube is long enough to allow the mouthpiece to be carried in the user's mouth to enable the user to draw water from the reservoir at will. Examples of hydration systems and mouthpieces therefor are disclosed in U.S. Pat. Nos. 5,727,714, 5,060,833, 5,085,349, and 6,070,767, the disclosures of which are hereby incorporated by reference.

Although personal hydration systems have proven to be a great advance over traditional water bottles, they do suffer from some drawbacks. One such drawback is providing a fluid reservoir with an interior that may be readily accessed by the user, such as for cleaning. Fluid reservoirs for hydration systems typically include a sealable opening through which a volume of fluid is added to the reservoir. An example of such an opening is a narrow-diameter neck that is sealed through a friction fit with a cap. Another example is a reservoir with an opening defined by generally opposed ribs that are sealed by compressing the ribs against each other, much like a ZIPLOCK™ brand storage bag. Still another example is a roll top, or folded, opening, much like a dry bag used in camping. These designs suffer from limitations regarding either their accessibility to the interior of the reservoir, or their durability, such as when exposed to repeated opening and closing and to external forces.

SUMMARY OF THE INVENTION

The present invention is directed to hydration systems with improved fluid reservoirs. The reservoirs include a fill port with a neck having an opening. The hydration systems further include a closure member, such as a cap, that selectively seals the opening, and an elongate drink tube through which a user may draw drink fluid from the reservoir, such as via a mouthpiece associated with the drink tube distal the reservoir. The hydration systems further include a wrench assembly that extends around the neck and includes handle that projects generally away from the neck. In some embodiments, the wrench assembly provides a counter lever to assist in the removal or coupling of the cap onto the neck. In some embodiments, the wrench assembly is removably mounted on the fill port, and in some embodiments, the wrench assembly is fixed secured to the fill port. In some embodiments, the wrench assembly is rotatably coupled to the fill port and in other the wrench assembly is non-rotatably coupled to the fill port. In some embodiments, the hydration system includes a pack into which the reservoir is received.

Many other features of the present invention will become manifest to those versed in the art upon making reference to the detailed description which follows and the accompanying sheets of drawings in which preferred embodiments incorporating the principles of this invention are disclosed as illustrative examples only.

DETAILED DESCRIPTION AND BEST MODE OF THE INVENTION

Figure 1:
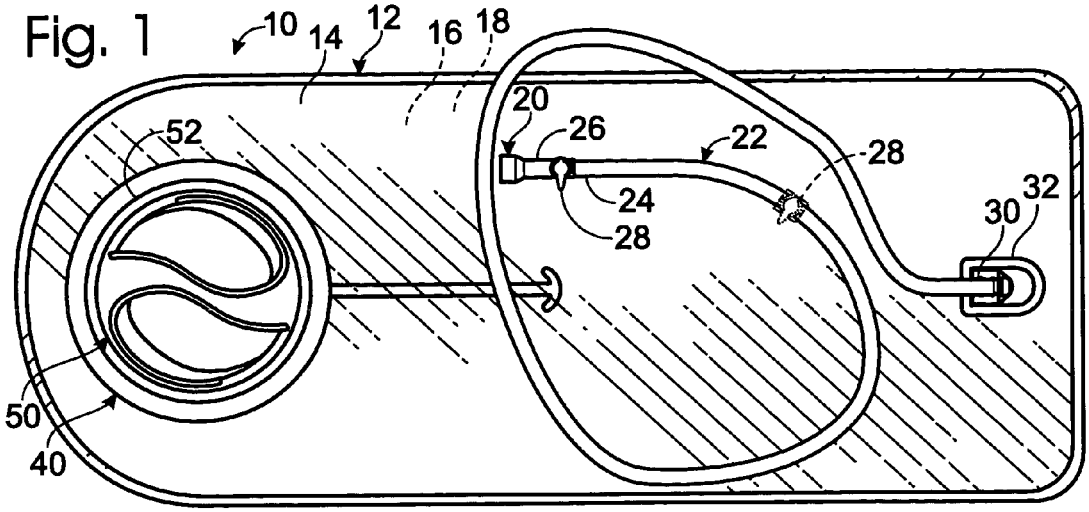
FIG. 1 is a top plan view of a personal hydration system constructed according to the present invention.
Figure 2:
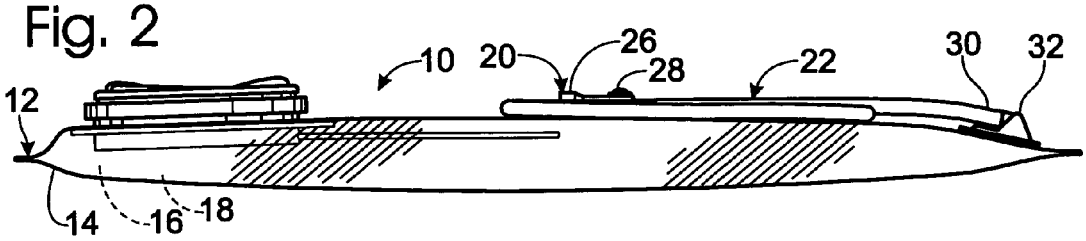
FIG. 2 is a side elevation view of the system of FIG. 1.

A personal hydration system constructed according to the present invention is shown in FIGS. 1 and 2 and generally indicated at 10. System 10 includes a fluid reservoir, or bladder, 12. Reservoir 12 includes a body portion 14 with an internal compartment 16, which is adapted to store a volume of drink fluid 18, such as water, sports drinks, juice, etc. At least the body portion, if not the entirety, of reservoir 12 is formed from a flexible, waterproof material. An example of a suitable material is polyurethane, although others may be used. The size and shape of compartment 16 may vary, such as depending upon the desired application with which the system will be used, any compartment or pack into which the reservoir will be placed, the mechanism by which the reservoir will be transported, and the volume of drink fluid that compartment 16 is designed to hold. Typically, compartment 16 will hold at least 24 ounces, and may hold as much as 32 ounces, 50 ounces, 70 ounces, 100 ounces, 200 ounces or more of drink fluid 18.

System 10 further includes a mouthpiece 20 that is connected to the reservoir by a flexible drinking tube 22. The length of tube 22 may vary, such as depending upon the desired distance between the user's mouth and the location where reservoir 12 is positioned, such as on a user's back, waist, inside a user's garments, on a user's bike or other equipment, etc. Mouthpiece 20 may have a variety of configurations, from an open end 24 of tube 22, to a device that is coupled to end 24. An example of a suitable mouthpiece is a bite-actuated mouthpiece 26, which is placed in a user's mouth and configured from a closed, or sealed, position, to an open, or dispensing, position when a user bites upon the mouthpiece or otherwise compresses the mouthpiece with the user's lips or teeth. Examples of suitable bite-actuated mouthpieces are disclosed in U.S. Pat. Nos. 6,070,767, 5,085,349 and 5,060,833, the complete disclosures of which are hereby incorporated by reference.

Also shown in FIGS. 1 and 2 at 28 is a manually actuated on/off valve, which is used to selectively prevent drink fluid from being dispensed through mouthpiece 20, regardless of the configuration of the mouthpiece. By "manually actuated," it is meant that the on/off valve is adapted to be actuated by a user exerting force on the valve, such as with the user's hands. Typically, a bite-actuated mouthpiece, or valve, will be self-sealing, in that it is adapted to automatically return to its closed position, while manually actuated on/off valves will typically remain in a selected position until repositioned by a user. Of course, valve 28 may also be spring-biased to return to its closed position. Examples of suitable manually actuated on/off valves are disclosed in U.S. Provisional Patent Application Ser. No. 60/217,124, the complete disclosure of which is hereby incorporated by reference for all purposes. It is within the scope of the present invention that hydration system 10 may be formed without a manually actuated on/off valve 28, with a different type of on/off valve, and/or with a manually actuated on/off valve that is positioned in an in-line configuration. By "in-line," it is meant that the valve is coupled between adjacent lengths of tube 22, as opposed to being connected in an end-of-line configuration between end 24 and mouthpiece 20. An example of an in-line configuration is generally indicated in dashed lines in FIG. 1.

The other end 30 of drinking tube 22 is connected to reservoir 12 by an exit port 32 through which drink fluid in the reservoir is received into tube 22. In other words, compartment 16 is in fluid communication with an exit port 32. Examples of suitable exit ports 32 are disclosed in U.S. Pat. Nos. 5,085,349 and 5,727,714, the complete disclosures of which are hereby incorporated by reference. End 30 may be integrally formed or otherwise fixedly attached to reservoir 12 and/or exit port 32, or alternatively may be selectively removed from and reattached to the exit port.

Figure 3:
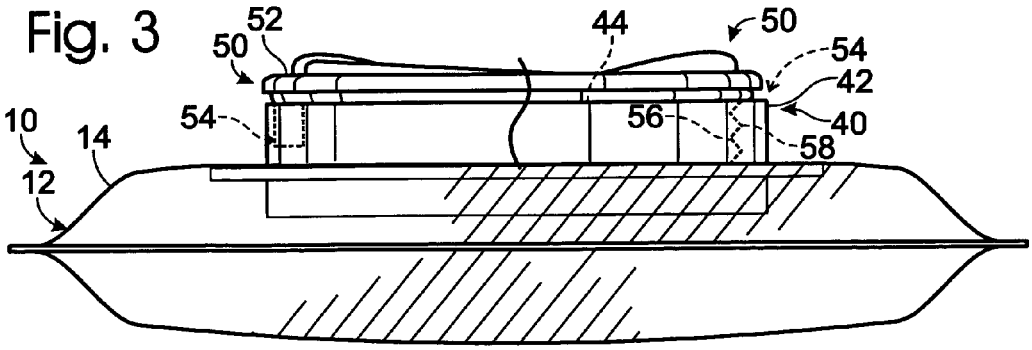
FIG. 3 is a fragmentary end view of the hydration system of FIGS. 1 and 2.

As perhaps best seen in FIG. 3, reservoir 12 includes an input port, or fill port, 40 through which drink fluid 18 may be poured into or removed from the reservoir. Fill port 40 also provides a passage through which the interior of compartment 16 may be accessed, such as for cleaning. As shown, fill port 40 includes a neck, or neck portion, 42 that extends from the body portion of the reservoir and includes an opening 44 through which drink fluid may exit the fill port. An illustrative height of neck 42 is shown in FIG. 3, but other shorter or higher heights may be used. Although body portion 14 is preferably flexible, neck 42 should tend to retain its configuration and thereby maintain a seal with the subsequently described closure member. Typically, neck 42 will have a defined shape, such as the circular, or cylindrical shape shown in FIGS. 1–3.

Neck 42 may be integrally formed with reservoir 12, or separately formed and then joined to the reservoir, such as by a suitable sealing mechanism. Examples of suitable sealing mechanisms include the use of an adhesive, heat sealing, and welding, such as ultrasonic or RF welding. In the illustrative embodiment shown in FIG. 3, fill port 40 includes a base 46 that provides a mounting surface 48 on which reservoir 12 may be secured, such as with one of the above-identified sealing mechanisms. Base 46 may additionally or alternatively be described as a perimeter flange. In the illustrative embodiment shown in FIG. 3, it can be seen that flange 46 extends radially outward from neck 42 and body portion 14 of reservoir 12 is shaped to extend in a generally planar fashion thereupon. As shown, body portion 14 extends over at least a portion of the perimeter flange, however, it is also within the scope of the invention that the body portion may extend under the flange, such as on mounting surface 48. It is also within the scope of the invention that the body portion may be secured between upper and lower portions of the flange, such as to provide additional leak prevention because the flange, or base, is fastened to the upper and lower surfaces of the corresponding region of body portion 14.

Preferably, neck 42 is sized to permit a user's hand to pass through opening 44. This increased diameter as compared to conventional reservoirs allows the reservoir to be more thoroughly and easily cleaned because the user's hand may reach completely into the reservoir to clean its interior. Similarly, cloths or brushes may be passed through the port, alone or along with the user's hand. Conventional fill ports have openings that are less than 2.5 inches in diameter, and therefore are too small for most, if not all, user's hands to fit therethrough.

The larger diameter input port also reduces spilling when the reservoir is filled, because there is a larger opening through which fluid may be poured, and enables the addition of larger pieces of ice than could be passed through conventional input ports. Preferably, opening 44 has a diameter of at least 2.5 inches, such as a diameter that is greater than 3 inches, a diameter that is greater than 4 inches, a diameter that is in the range of 3 and 4 inches, and a diameter that is in the range of 3 and 5 inches. Diameters of approximately 3.25 and 3.5 inches have proven effective. Such a diameter enables the hands of most users to pass completely through the opening. Fill port 40 may also be described as preferably having an opening of at least approximately 5 square inches, and more preferably having a neck of at least approximately 8–10 or more square inches.

It should be understood that the hand size of potential users may vary, and therefore it is not essential to the scope of the present invention that every user's hands can completely pass through opening 44. Similarly, although an enlarged diameter input port is preferable, it should be understood that hydration systems that contain smaller diameter openings along with other elements described herein are also within the scope of the present invention. For example, the subsequently described tethers, closure members, wrench assemblies, handles, packs and positioning members described herein may be used with conventional sizes and styles of input ports and reservoirs.

System 10 further includes a filler cap assembly 50 that is adapted to be secured to fill port 40 to obstruct opening 44 and thereby prevent drink fluid from passing therethrough. Filler cap assembly 50 includes a closure member, such as a cap 52, that is selectively secured to neck 42 to prevent drink fluid from passing through the opening. Neck 42 and cap 52 are selectively secured together by any suitable releasable fastening mechanism 54 that permits the cap to be secured to the neck to prevent drink fluid from passing through opening 44, and also to be selectively removed from the neck, such as to add or remove drink fluid from the reservoir or to clean the reservoir, and thereafter be resecured thereto. Examples of suitable fastening mechanisms include threads, pin-and-slot mechanisms, a snap fit between corresponding tongues and grooves on the neck portion and cap, and a friction fit between the cap and a corresponding portion of the fill port. However, any suitable fastening mechanism meeting the above criteria may be used. A fastening mechanism 54 is generally illustrated in dashed lines on the left side of FIG. 3, and a particular example of a fastening mechanism, namely corresponding sets of threads 56 and 58, is shown in dashed lines on the right side of FIG. 3. A benefit of such a configuration is that it provides additional protection against leaks caused by external forces applied to the reservoir that could cause weaker seals, such as friction fits, to fail or otherwise leak.

Figure 4:
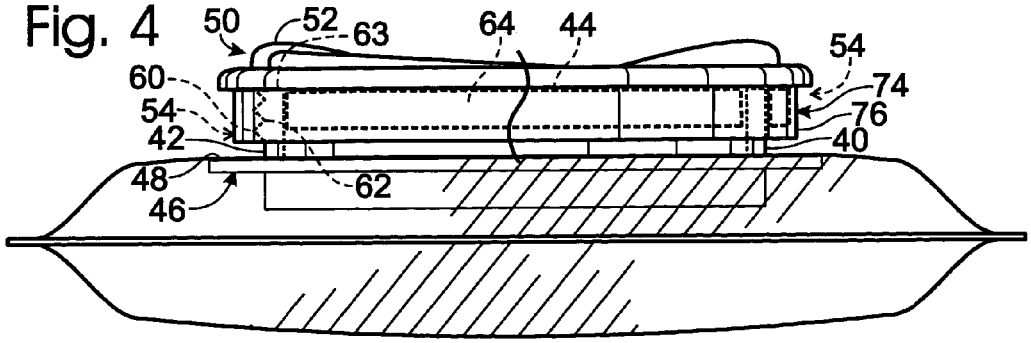
FIG. 4 is the fragmentary end view of FIG. 3 showing another suitable cap configuration.

In the illustrative embodiment of neck 42 shown on the right side of FIG. 3, the neck contains internal threads 56, and cap 52 contains a corresponding set of external threads 58. However, it should be understood that it is within the scope of the invention that neck 42 may contain external threads 60 and cap 52 may contain internal threads 62, such as shown on the left side of FIG. 4. In such a configuration, cap 52 is wider than the neck and extends across the terminal edge 63 of neck 42. In contrast, an externally threaded cap may, but does not necessarily, have a diameter and a thickness that are less than the corresponding diameter and thickness of the neck. It is further within the scope of the invention that a cap 52 that seals against the exterior surface of neck 42 may contain any of the other fastening mechanisms 54 described above, such as generally indicated on the right side of FIG. 4. An internally threaded cap may extend across opening 44, or may include a plug portion 64 that extends through the opening, such as shown in dashed lines in FIG. 4. In such an embodiment, the plug portion may or may not be configured to form a seal with the internal surface of neck 42.

Figure 5:
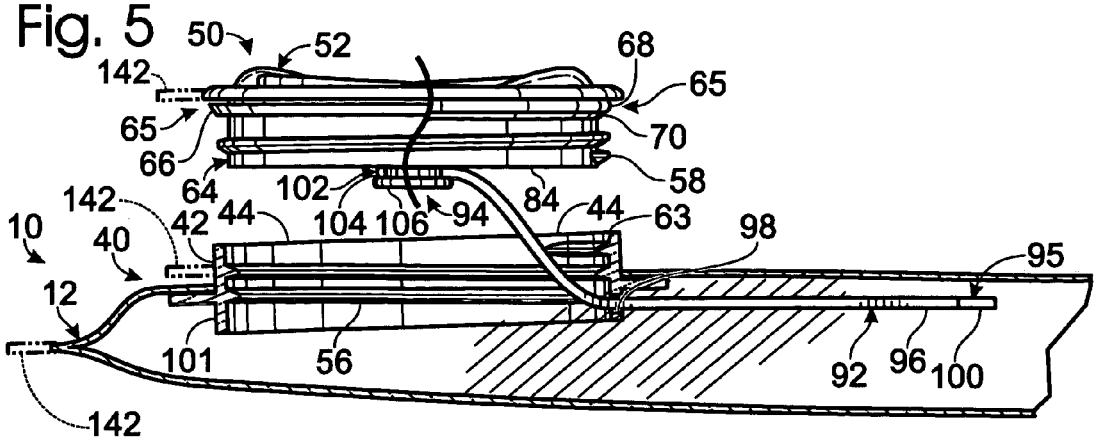
FIG. 5 is a fragmentary partial cross-sectional side elevation view of the filler cap assembly of the hydration system of FIG. 3, with the cap removed from the neck of the reservoir.

Filler cap assembly 50 preferably forms a watertight seal with fill port 40. This seal may be provided by the sealing mechanism used to secure cap 52 to fill port 40. Additionally or alternatively, the cap may include a seal member 65 that provides increased protection against leaks. Two illustrative examples of seal members 65 are shown in FIG. 5. On the left side of FIG. 5, the cap includes a deflectable member 66 that extends from the cap. The deflectable member deflects from the unbiased, or open, position shown in FIG. 5, to the sealing position shown in FIG. 3 as the cap is mounted on fill port 40. In the sealing position, the deflectable member forms a surface of contact against the neck, with member 66 being urged more tightly against the neck as the cap is screwed more tightly onto neck 42. On the right side of FIG. 3, cap 52 is shown including a seal member 65 in the form of a deformable gasket or washer 68. Also shown is an optional positioning member 70, such as a projecting rib, plurality of ribs, ring, or other suitable structure 72 that retains the gasket or washer in a desired position relative to the rest of the cap.

It should be understood that it is within the scope of the present invention that cap 52 may have configurations other than the plug or internally threaded cap configurations shown and described above. Cap 52 preferably includes a user-grippable region 74 that is adapted to be grasped by a user to secure or release the cap from neck 42. For example, an internally threaded cap may include an external edge 76 that is textured or otherwise shaped or contoured to be firmly grasped by a user, even if the user's hand or the edge are wet. As another example, cap 52 may include a projecting handle that a user grasps and uses like a lever arm to selectively secure the cap to the neck, or remove the cap from the neck.

In both of the above examples, the user-grippable portion extends outward from the cap's sealing mechanism. As another example, the user-grippable portion may be formed generally radially inward of the cap's sealing mechanism, such as shown in FIGS. 6–9. As shown, the plug portion 64 includes a pair of recesses 78 that are separated by a handle portion 80. Recesses are sized to receive a portion of a user's thumb and at least one finger as the user grasps handle portion 80. To remove cap 52 from reservoir 12, the user grasps handle portion 80 between the user's thumb and index or other fingers. The user then twists or otherwise manipulates the closure member to release the sealing mechanism, such as threads 56 and 58. Other suitable shapes and configurations of handle portions may be used. In FIGS.

Figure 6:
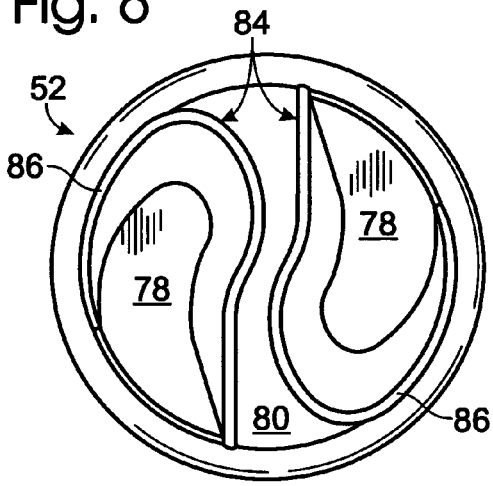
FIG. 6 is a top plan view of the cap of the hydration system of FIG. 1, with ornamental design details shown for purposes of illustration.
Figure 7:
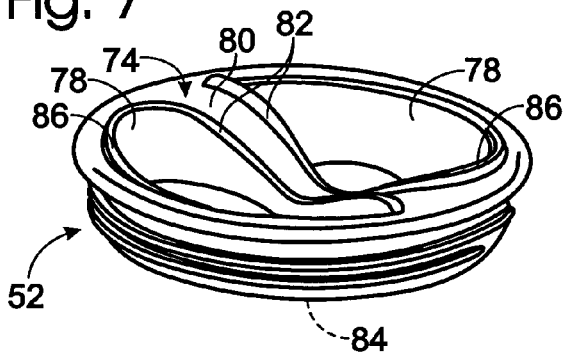
FIG. 7 is an isometric view of the cap of FIG. 6.
Figure 8:
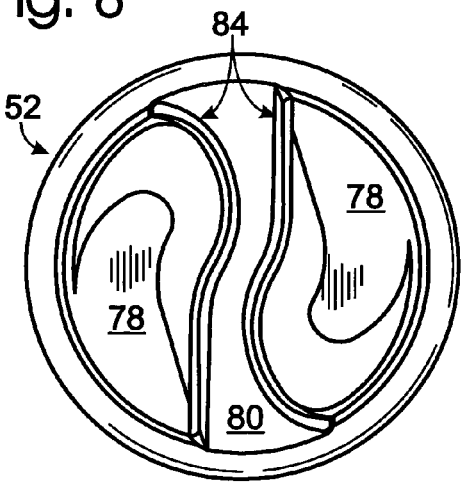
FIG. 8 is a top plan view of a variation of the cap of FIG. 6.
Figure 9:
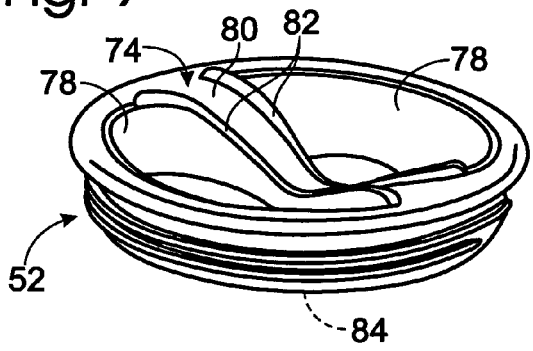
FIG. 9 is an isometric view of the cap of FIG. 8.

6–9, handle portion 80 is shown including edge portions 82 and extend generally away from the lower surface 84 of the cap to provide a larger surface upon which a user's fingers may grasp the cap. In FIGS. 6–7, edge portions 82 extend along the length of handle portion 80 and include end regions 86 that extend further from lower surface 84 than the rest of the edge portions. In FIGS. 8–9, edge portions 82 further extend at least partially around portions of recesses 78 that are not bounded by handle portion 80. It is also within the scope of the present invention that edge portions 82 may not project beyond the rest of handle portion 80, and that handle portion 80 may be sized to extend no further away from reservoir 12 than fill port 40, thereby reducing the thickness of the fill port portion of the hydration system.

It should be understood that these configurations are shown for purposes of illustration, and that other suitable configurations may be used and are within the scope of the invention. For example, user-grippable region 74 may be formed without recesses 78, in which case the handle portion will tend to project further away from surface 84 than in the illustrated embodiments. Similarly, the edge portions 82 may be shaped to provide a generally planar distal edge so that the cap does not include isolated peaks or projections, such as shown in dashed lines in FIG. 12. It should also be understood that the user-grippable portion shown in FIGS. 6–9 includes surface ornamentation, such as the curved shape of the handle portion, shape of the recesses and detailing within the recesses, which is not required for operation of the present invention.

Upon release from fill port 40, cap 52 may be free from association with the hydration system, meaning that the cap is not coupled or retained near the hydration system. A benefit of such a configuration is that the cap may be moved to any selected position regardless of the corresponding position of the reservoir. A disadvantage of such a configuration is that the cap may be misplaced, lost, dropped, etc. Therefore, filler cap assembly 50 may additionally include a tether, or lanyard, 92 that couples the cap to the hydration system when the cap is released from the fill port, and thereby limits the degree to which the cap may be removed from the hydration system. For example, the tether 92 may interconnect the cap with the body portion, fill port, or other portion of the hydration system. For purposes of illustration, a tether 92 that interconnects cap 52 with fill port 40 is shown by referring back to FIG. 5. Tether 92 may vary in length, although it is preferably of sufficient length that cap 52 may be moved to a position where it does not obstruct the insertion or removal of drink fluid from reservoir 12.

As shown, tether 92 includes an end region 94 that is coupled to cap 52, and another end region 95 that prevents the unintentional removal of the tether from the fill port. Regions 94 and 95 may be fixedly secured to the fill port and/or cap 52, and may even be integrally formed therewith. In the illustrated embodiment, tether 92 includes a central region 96 that extends through an aperture 98 in fill port 40, and region 95 takes the form of an anchor 100 that is sized so that it will not pass through aperture 98 when the cap is drawn away from the reservoir. Instead, anchor 100 is either at all times incapable of passing through aperture 98, or requires intentional manipulation of the anchor by a user to orient the anchor into a position where it will pass through the aperture. In the illustrated embodiment, central portion 96 is slidably received through aperture 98, with the anchor being drawn toward the aperture as the cap is drawn away from fill port 40. As shown, aperture 98 is formed in a member 101 that extends radially around port opening 44. However, fill port 40 may alternatively include only a projecting tab through which aperture 98 is formed, such as shown and described subsequently herein.

Figure 10:
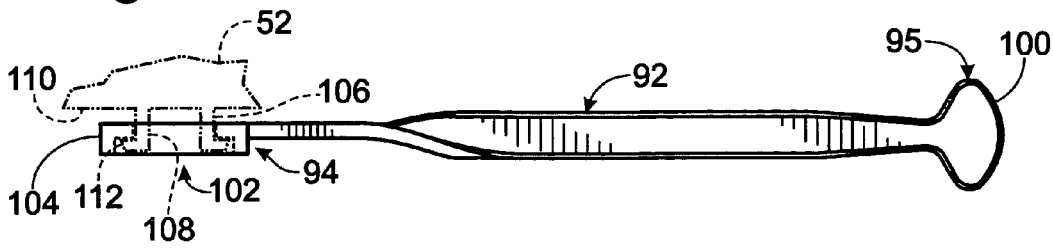
FIG. 10 is a partial cross-sectional plan view of another tether constructed according to the present invention.

Region 94 is coupled to the cap using any suitable structure. For example, in FIG. 5, region 94 includes a coupling 102 in the form of a ring 104 that is adapted to be attached to a mount 106 on cap 52. In FIG. 10, another example of a suitable tether 92 is shown, with the central region being twisted to better illustrate the structure of regions 94 and 95. As shown, mount 106 includes one or more projections 108 that extend from the underside of cap 52, with the projections including feet 112 that are adapted to prevent the unintentional removal of the projections through the ring. As discussed, it is also within the scope of the present invention that the hydration system may be formed without a tether 92, and that the tether may interconnect the cap with other portions of the hydration system, such as with neck 42, a pack into which the reservoir is inserted, or a portion of the reservoir's body, such as a projecting mount on the outer surface of the body, or a perimeter portion that is distal compartment 16.

Figure 11:
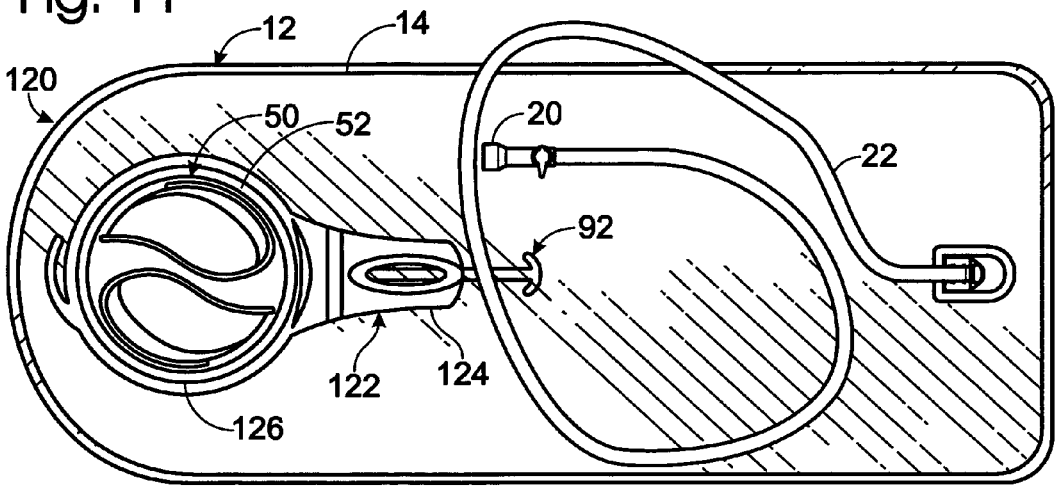
FIG. 11 is a fragmentary top plan view of another personal hydration system constructed according to the present invention.
Figure 12:
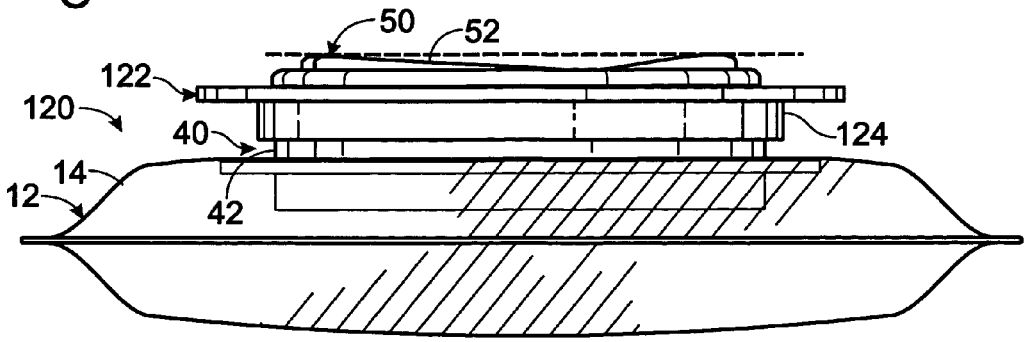
FIG. 12 is an end elevation view of the hydration system of FIG. 11.

Another embodiment of a personal hydration system constructed according to the present invention is shown in FIGS. 11 and 12 and generally indicated at 120. Unless otherwise specified, system 120 may be formed with the same elements, subelements and/or variations as the other hydration systems described, illustrated and/or incorporated herein. For example, system 120 includes a reservoir 12, a mouthpiece 20, a flexible drink tube, or hose, 22, a fill port 40, and a filler cap assembly 50 with a cap 52. Similarly, it should be understood that the other hydration systems described, illustrated and/or incorporated herein may be formed with the elements, subelements and variations described and illustrated in connection with system 120.

Hydration system 120 includes a wrench assembly 122 that projects from fill port 40 and which includes a handle portion 124 that is adapted to be grasped by a user, such as to support reservoir 12 and/or the entire system 120. For example, a user may hold handle portion 124, which extends generally midway between the upper and lower ends of the reservoir, to position opening 44 horizontally and thereby completely fill the reservoir with drink fluid.

Handle 124 may additionally or alternatively be used to provide support for the reservoir as filler cap assembly 50, such as cap 52 is grasped to secure the cap on neck 42 or to remove the cap therefrom. For example, recall that reservoir 12, or at least body portion 14 thereof, is at least typically formed from a flexible material, which is fastened to fill port 40. As a user grasps filler cap assembly 50 and twists or otherwise urges the closure member to move relative to the reservoir, this movement of the closure member relative to the reservoir tends to impart forces to the reservoir, such as to tend to stretch or twist the reservoir. To prevent these forces from damaging the reservoir or developing leaks in the seal between the body portion and the fill port, it may be desirable to support the fill port to at least partially, if not substantially or completely, isolate these forces.

Wrench assembly 122 provides an example of such a support and isolation mechanism. Accordingly, hydration system 120 may be described as having a pair of handles, with a first handle 80 being adapted to secure and release cap 52 from neck 42, and a second handle 124 that is separately formed from the first handle. Handle 124 provides a mechanism for holding the filled or empty reservoir, as well as for maintaining the fill port in a desired orientation when the reservoir is filled. Handle 124 also provides a counter lever, or torque member to counteract the forces exerted upon the closure member to secure or release the closure member from fill port 40. In the illustrated embodiment, handle 124 is elongate and has a long axis that extends away from fill port 40. As such, handle 124 is typically grasped by a user so that the lateral edges 125 (shown in FIG. 13) of the handle extend across the user's palm generally transverse to the user's fingers, with the user's fingers and thumb all extending above the handle or below the handle. It should be understood that it is within the scope of the invention that handle 124 may have other configurations so long as at least one of the above criteria is satisfied.

Figure 13:
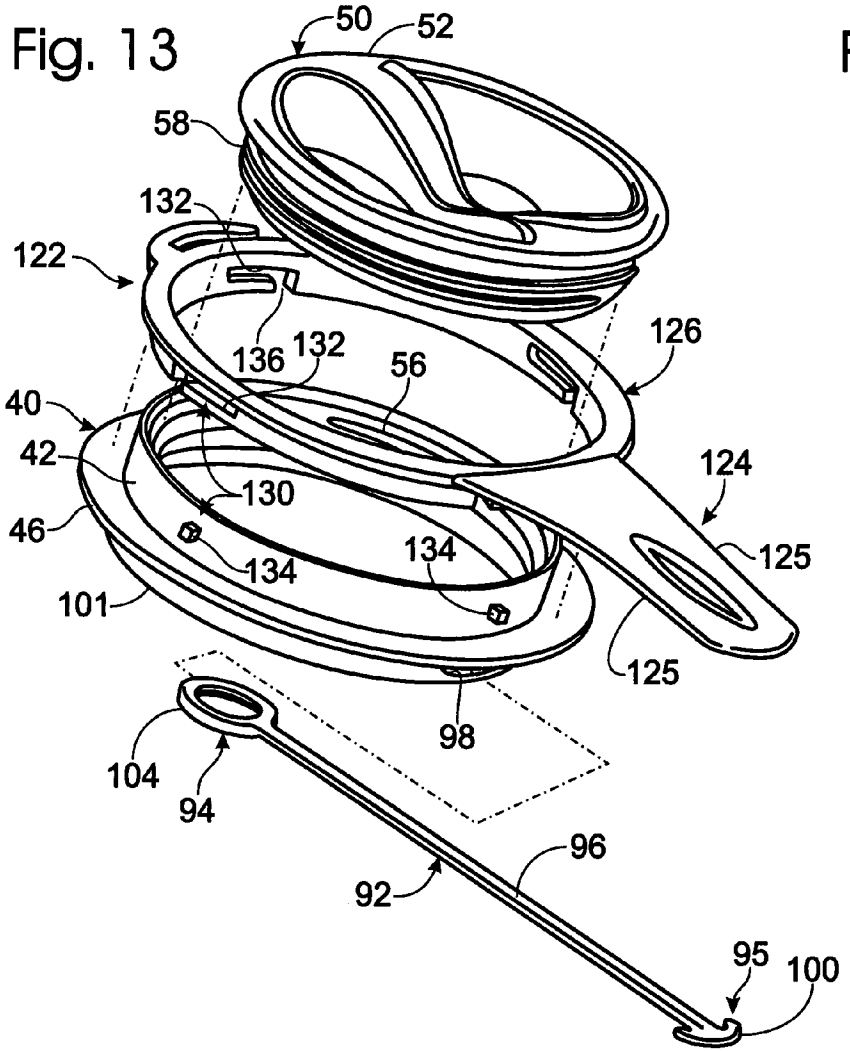
FIG. 13 is an exploded isometric view of the fill port and filler cap assembly of the hydration system of FIGS. 11 and 12.

In the illustrated embodiment shown in FIGS. 11–13, wrench assembly 122 includes a support member 126 that encircles neck 42 of fill port 40 and is secured thereto. Although support member 126 is shown completely encircling neck 42, it is within the scope of the invention that the support member may only substantially or partially encircle the neck, or even that the support member may merely provide a point of attachment from which handle portion 124 extends. Illustrative demarcations of these alternatives are shown in dashed lines in FIG. 13.

Member 126 may be either fixedly secured to the neck or other portion of fill port 40 or removably secured to the neck or other portion of the fill port. By "fixedly secured," it is meant that member 126 is not removable from neck 42 or other portion of fill port 40 without destroying at least a portion of the wrench assembly or fill port. By "removably secured," it is meant that the support member may be repeatedly removed from, and reattached to, neck 42 or another portion of fill port 40. Fixedly secured members 126 include members that are integrally formed with neck 42 or another portion of fill port 40, and members that are secured thereto with an adhesive, weld, or other form of permanent fastening mechanism. Removably secured members 126 include members that are coupled to neck 42 or another portion of fill port 40 by any of the previously described mechanisms identified in connection with fastening mechanism 54, such as threads, pin-and-slot mechanisms, a snap fit between corresponding tongues and grooves on the neck and support member, and a friction fit between the neck and corresponding portion of the fill port. When wrench assembly 122 is removably secured to fill port 40, the hydration system may be used without the wrench assembly, and the wrench assembly may be removed and replaced with a different wrench assembly, such as to provide additional structure or features not present in the removed version of the wrench assembly. Accordingly, the hydration system may be described as having an interchangeable wrench assembly.

For purposes of illustration, a releasable support member 126 is shown in FIG. 13, and is releasably secured to neck 42 by fastening mechanisms 128 in the form of pin-and-slot mechanisms 130. As shown, member 126 includes a plurality of slots 132 into which corresponding pins, or teeth, 134 from neck 42 extend. In the illustrated embodiment, four slots 132 are shown, although it should be understood that the number of slots (and/or corresponding pins) may vary from as few as one, two or three slots (and/or pins) to more than four slots (and/or pins). Mechanism 130 may also be described as including a plurality of teeth or projections that are selectively engaged by corresponding catches to couple the wrench assembly with the fill port. It should also be understood that the support member may include the pins, with neck 42 including slots 132, and that other suitable fastening mechanisms may be used.

Figure 14:
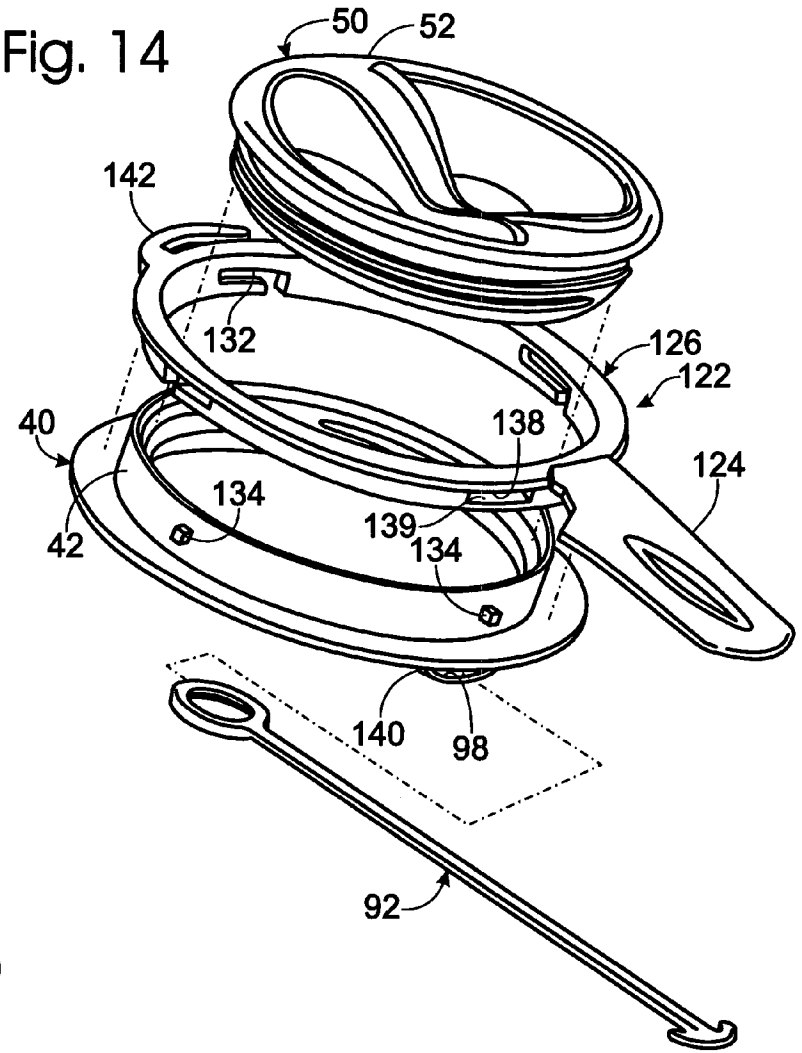
FIG. 14 is an exploded partial fragmentary isometric view showing a variation of the wrench assembly of FIG. 13.
Figure 15:
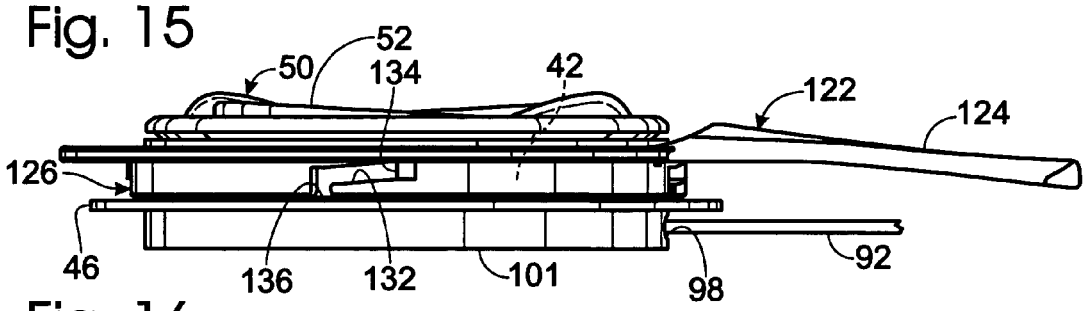
FIG. 15 is a side elevation view of the fill port, filler cap and wrench assemblies of FIGS. 11–13.

In FIG. 13, each slot 132 is shown being open radially outward from neck 42 as well as open toward flange 46. This latter opening 136 enables the wrench assembly to be positioned onto neck 42 from above the neck, such that the pins pass into the corresponding lower openings in slots 132, and then rotated relative thereto to secure the pins into the distal portions of the slots, such as shown in FIG. 15. In FIG. 14, a variation of the pin-and-slot fastening mechanism is shown, in which one of the slots 138 is closed relative to the flange. As shown, a member 139 extends across the portion of slot 136 that forms opening 136 in corresponding slots 132. To mount the wrench assembly shown in FIG. 14 onto neck 42, slot 138 is mounted on its corresponding pin 134, then the remaining pins are inserted into their respective slots, and wrench assembly 122 is rotated to seat those remaining pins. A benefit of such a mechanism is that the wrench assembly cannot be removed from the hydration system simply by rotating the wrench assembly relative to fill port 40. Instead, the wrench assembly must be rotated, tilted at an angle to remove pins 134 from slots 132, and then moved away from fill port 40 to remove slot 136 from engagement with its corresponding pin. Accordingly, such a system protects against unintentional removal of the wrench assembly.

Also shown in FIG. 14 are additional details of the tether shown in FIG. 5, as well another suitable configuration for the region of fill port 40 that defines aperture 98. As shown, aperture 98 is formed within a tab 140 that projects generally away from opening 44. In FIG. 14, system 120 is also shown including a catch 142 that may be used to hang the hydration system, such as within a pack, on a user's clothing, on a hanger, etc. As shown, catch 142 extends from wrench assembly 122. It is also within the scope of the invention that catch 142 may extend from reservoir 12, fill port 40 (such as from neck 42), and/or from filler cap assembly 50 (such as from cap 52). These additional positions for catches 142 are schematically indicated in dashed lines in FIG. 5. Catch 142 may also be described as a positioning device or hook.

Figure 16:
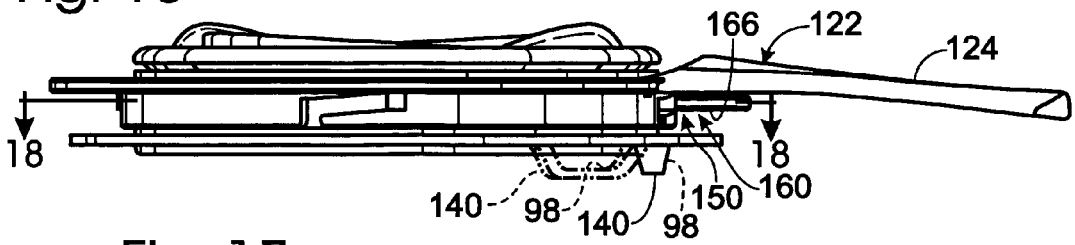
FIG. 16 is a side elevation view showing another fill port, filler cap assembly and wrench assembly constructed according to the present invention.
Figure 17:
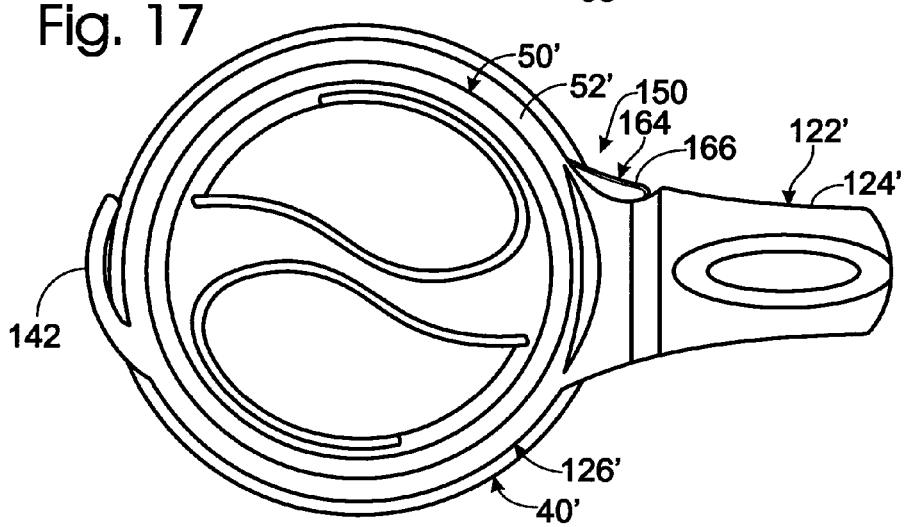
FIG. 17 is a top plan view of the filler cap assembly of FIG. 16.
Figure 18:
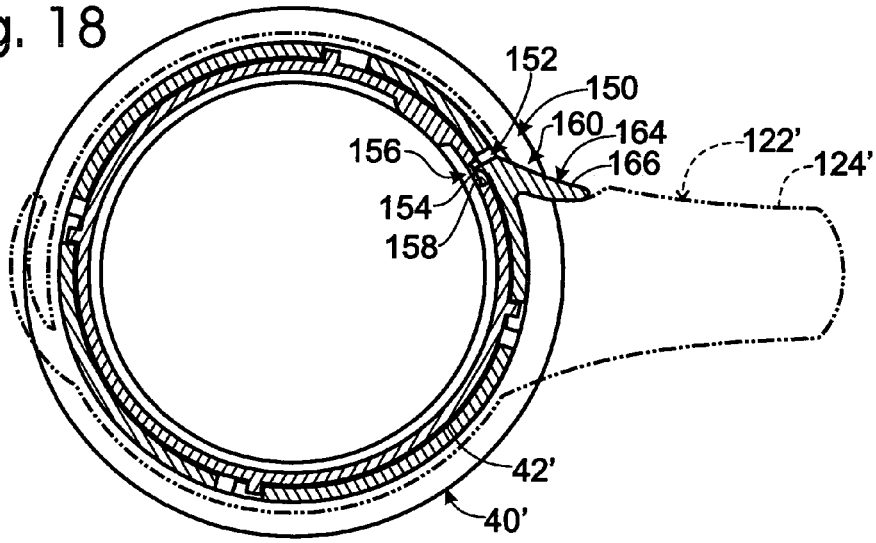
FIG. 18 is a cross-sectional view of the filler cap assembly of FIG. 17.

In FIGS. 16–18, the fill port, filler cap assembly, and wrench assembly portions of another personal hydration system constructed according to the present invention are shown and generally indicated at 40', 50' and 122'. Unless otherwise set forth herein, fill port 40', filler cap assembly 50' and wrench assembly 122' may have the same elements, subelements and variations as the previously described fill port and wrench assembly, and may be used with any of the personal hydration systems described, illustrated and incorporated herein. As perhaps best seen in FIG. 18, wrench assembly 122' includes a lock mechanism 150 that selectively secures the wrench assembly onto fill port 40', thereby preventing wrench assembly 122' from being rotated or otherwise moved to a position where it would otherwise be released from engagement from fill port 40'. A benefit of such a lock mechanism is that handle portion 124' may be used to position and support the entire hydration system, even when the reservoir is filled with drink fluid, without concern that inadvertent twisting or pulling on the handle portion will cause the wrench assembly to disengage the fill port. Similarly, because the wrench assembly is retained in a defined position, or limited range of positions, when it is in the locked configuration, the handle portion provides a counter lever that may be used as a brace against the force required to secure cap 52' to neck 42', as well as the force required to release cap 52' from neck 42'.

In the illustrative embodiment shown in FIG. 18, lock mechanism 150 includes a lock member 152, such as tooth 154, which selectively engages a lock receptacle 156, such as detent 158, to selectively lock the wrench assembly and fill port together. As shown, detent 158 is formed in support member 126, and tooth 154 is movable relative thereto. It is within the scope of the invention that this relationship may be reversed. Lock mechanism 150 further includes a release mechanism 160 that selectively configures the lock mechanism to its unlocked position, in which the wrench assembly may be removed from the fill port, such as from neck 42'. Release mechanism 160 includes a user-actuable element 164 that upon receipt of user-applied forces causes the release of the lock member and lock receptacle. As shown, element 164 takes the form of a lever 166 that draws tooth 154 out of detent 158 when a user presses upon the lever, such as with a user's thumb, finger, or another portion of the user's hand. User-actuable element 164 may be configured, or biased, to automatically return to its locked position, such as shown in FIG. 20, or may be configured to remain in a user-selected position (such as a locked or unlocked configuration) until moved from this position by another user-applied force.

Figure 19:
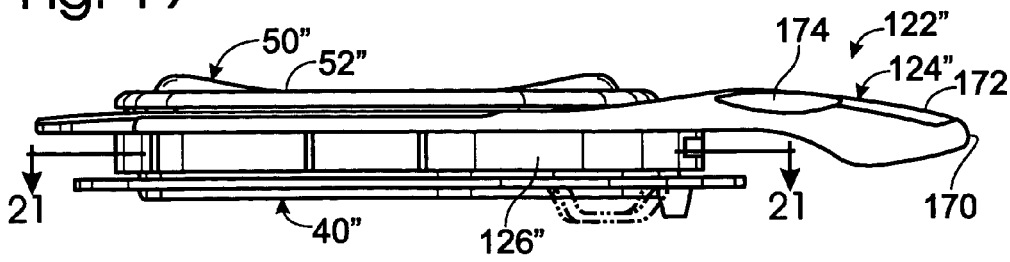
FIG. 19 is a side elevation view showing another wrench assembly and filler cap assembly constructed according to the present invention and shown mounted on the fill port of FIG. 16.
Figure 20:
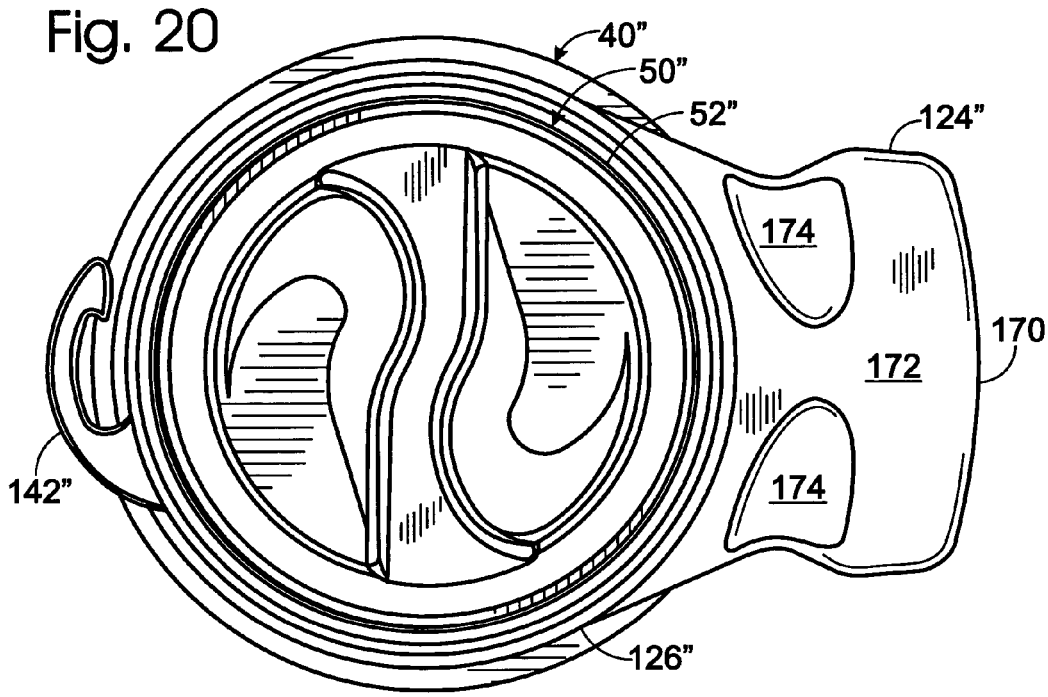
FIG. 20 is a top plan view of the filler cap assembly of FIG. 19.

In FIGS. 19–20, the fill port, filler cap assembly, and wrench assembly portions of another personal hydration system constructed according to the present invention are shown and generally indicated at 40", 50" and 122". Unless otherwise set forth herein, fill port 40", filler cap assembly 50" and wrench assembly 122" may have the same elements, subelements and variations as the previously described fill port and wrench assembly, and may be used with any of the personal hydration systems described, illustrated and incorporated herein. As shown in FIGS. 19 and 20, wrench assembly 122" includes a handle portion 124" having a different configuration from the previously illustrated handles or handle portions, such as handle 124. As shown, handle portion 124" has a long axis that extends transverse or radially around the fill port 40" and is adapted to be grasped by a user such that the terminal edge 170 of the handle generally faces a user's palm, with the user's thumb placed upon the upper surface 172 of the handle portion, such as in one of recesses 174, and the user's fingers extend beneath the handle portion.

Figure 21:
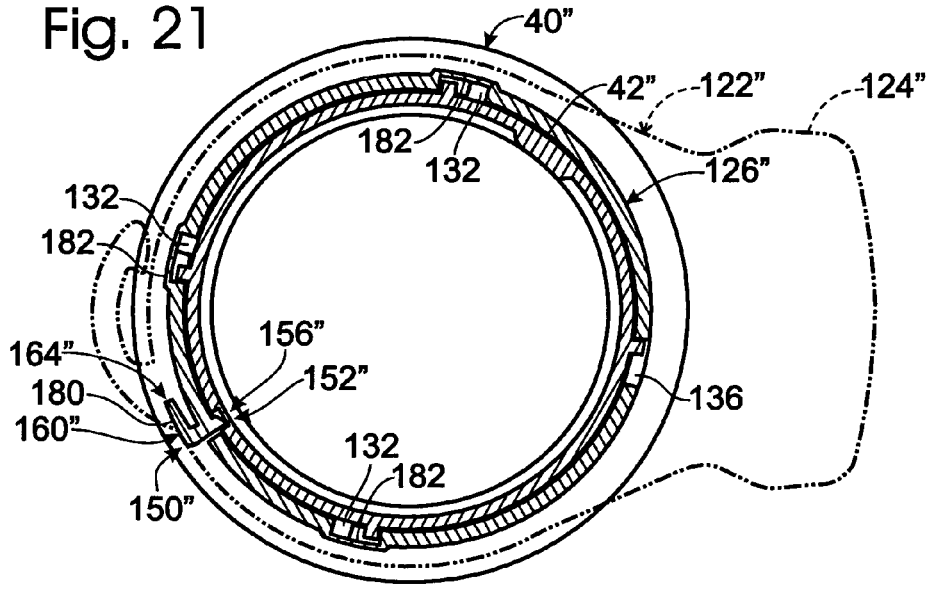
FIG. 21 is a cross-sectional view of a variation of the filler cap assembly of FIG. 20, with the wrench assembly of FIG. 20 shown in dashed lines.

In FIG. 21, wrench assembly 122" and fill port 40" also illustrate another example of a suitable lock mechanism, which is generally indicated at 150". Unlike the previously illustrated embodiment, in which user-actuable element 164 was positioned on handle portion 124', element 164" of release mechanism 160" is positioned apart from handle portion 124" to demonstrate that the lock mechanism may be located in a variety of positions relative to the handle portion. Similarly, element 164" is adapted to be pulled away from neck 42", as opposed to being pushed generally toward neck 40" to further illustrate that release mechanism 160 may be configured to be actuated by a variety of different user-applied forces. For example, mechanism 160" may be actuated by inserting a fingernail, screw driver, or other lever under tab 180 and then urging element 164" away from neck 42" so that lock member 152" is released from lock receptacle 156".

In FIG. 21, another suitable configuration for the pin-and-slot mechanisms 130 that are used to couple wrench assembly 122" to fill port 40" is shown. More specifically, FIG. 21 illustrates slots 132 with covers 182 that extend radially outward from neck 42". Covers 182 increase the strength of support member 126" by providing additional material in the regions of slots 132, thereby reducing the comparative load applied to the portions of support member 126" immediately adjacent slots 132. For purposes of illustration, three slots 132 include covers 182, while a fourth slot 136 does not. It should be understood, however, that all of the slots may include covers 182, none of the slots may include covers, or only some of the slots may include covers.

Figures 22, 23, 24, 25:
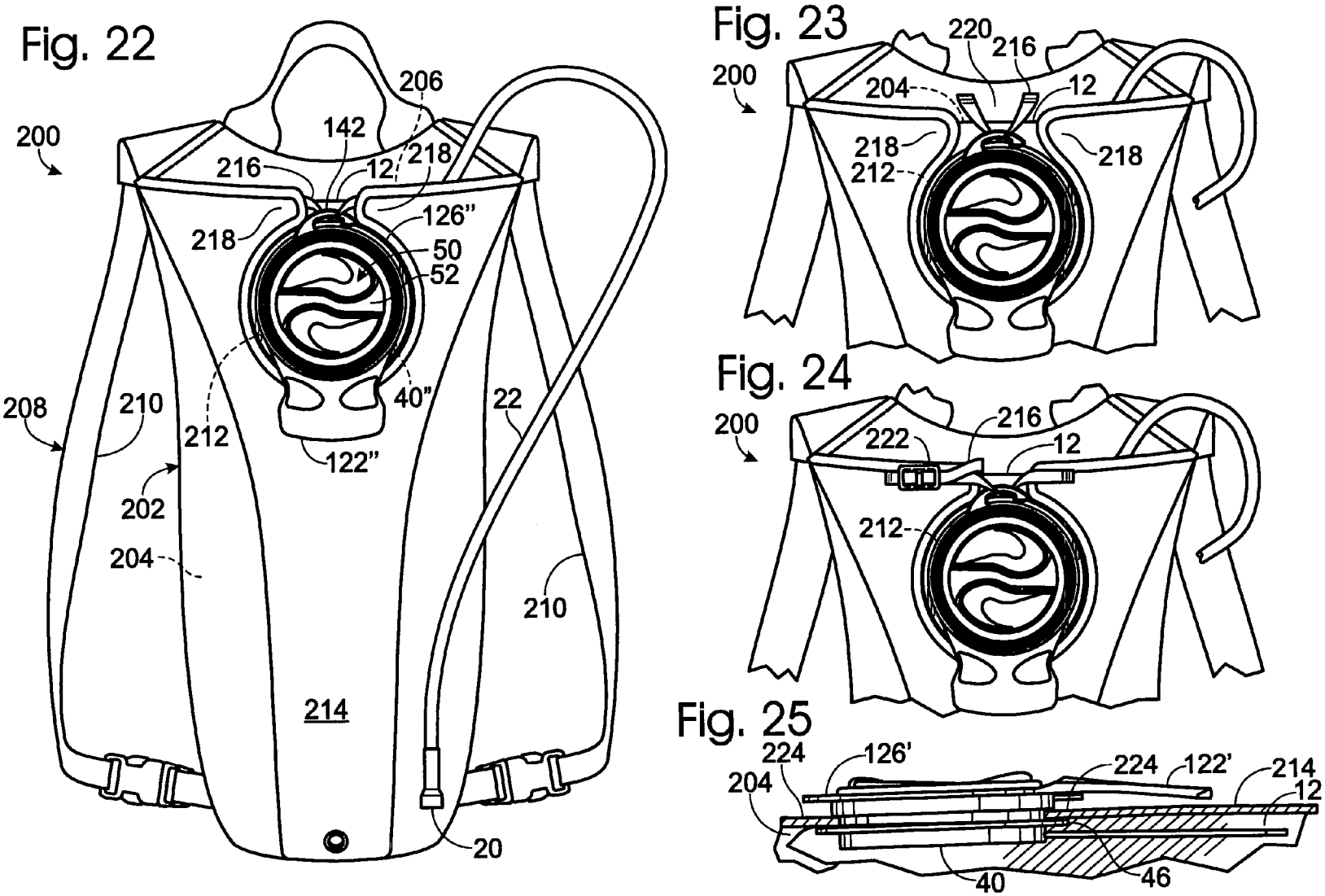
FIG. 22 is a top plan view of another personal hydration system constructed according to the present invention.
FIG. 23 is a fragmentary detail from the hydration system of FIG. 22 showing a variation of the reservoir mount of FIG. 22.
FIG. 24 is a fragmentary cross-sectional detail showing a variation of the reservoir mount shown in FIG. 22.
FIG. 25 is a fragmentary partial cross-sectional detail from the hydration system of FIG. 22, with the wrench assembly of FIG. 17.

Another personal hydration system constructed according to the present invention is shown in FIG. 22 and generally indicated at 200. Unless otherwise specified, system 200 may be formed with the same elements, subelements and/or variations as the other hydration systems described herein. For example, system 200 includes a reservoir 12, a mouthpiece 20, a flexible drink tube, or hose, 22, a fill port 40, and a filler cap assembly 50 with a cap 52. System 200 is shown also including a wrench assembly 122", but it should be understood that system 200 may be formed without a wrench assembly. Similarly, it should be understood that the other hydration systems described, illustrated and/or incorporated herein may be formed with the elements, subelements and variations described and/or illustrated in connection with system 200. To illustrate that system 200 may be used with any of the previously described, illustrated and/or incorporated elements, subelements and variations, FIG. 23 shows system 200 including a previously discussed wrench assembly 122', and fill port 40 that are different than the wrench assembly 122" and fill port shown in FIG. 22.

System 200 further includes a pack 202 with an internal compartment 204 into which reservoir 12 is received. Typically, reservoir 12 is removably received into compartment 204, such as through opening 206, but it is within the scope of the invention that the reservoir may be permanently received into the compartment. Pack 202 further includes body-mounting straps 208, such as a pair of shoulder straps 210. It is also within the scope of the invention that straps 208 may take the form of a single shoulder strap and/or strap that is adapted to extend around a user's waist.

As shown, cap 52 is accessible through an opening 212 in the rear surface 214 of the pack. Although it is within the scope of the invention that the reservoir may be used without a pack or placed into a pack that does not include an opening through which cap 52 extends, a configuration in which the cap is accessible through an opening in the pack permits the reservoir to be filled or emptied through fill port 40 without removing the reservoir from the pack.

Also shown in FIG. 22 is a retainer, or positioning device, 216 on the pack that is adapted to be engaged by a corresponding positioning device, or clasp, 142 on wrench assembly 122 to support the reservoir within the pack. Positioning devices 142 and 216 may also be described as a positioning assembly or hanger assembly that supports the reservoir within the pack's compartment to prevent the reservoir from accumulating in the lower portion of compartment 204. Because the upper portion of the reservoir is directly or indirectly retained proximate device 216, that portion of the reservoir cannot shift or drop to the lower portions of the pack's compartment. In FIG. 22, device 216 extends between opposed regions 218 of the pack's rear, or outer, surface 214 to provide opening 212 with a closed perimeter and to cooperate with device 142 to hang, or support, the reservoir from to the rear, or outer, surface of the pack. In FIG. 23, device 216 is shown extending from the inner surface 220 of the pack, and this position may also be described as extending from within compartment 204 of the pack. In FIG. 24, device 216 is adjustable to enable the position of the reservoir defined by device 216 to be adjusted and/or to release regions 218 to be flexed away from each other. An illustrative example of a suitable adjustment device 222 is shown in FIG. 24, but any suitable adjustable or releasable mechanism may be used.

In FIG. 25, handle portion 124" of wrench assembly 122" is shown extending external pack 202, thereby permitting the handle portion to be grasped by a user when the reservoir is seated within the pack. This positioning of the handle assembly may provide the additional benefit that the wrench assembly prevents the wrench assembly (and fill port on which it is mounted) from falling to the lower portion of the pack's compartment because the wrench assembly at least partially overlaps with the pack's rear, or outer, surface 214 that defines opening 212. It is also within the scope of the invention that support member 126 of the wrench assembly is larger than opening 212, such as shown in FIG. 25, in which support member 126 overlaps with the region 224 of the pack's rear, or outer, surface that defines opening 212, and handle portion 124' extends away from fill port 40 across the outer surface of the pack. These overlapping portions may cooperate to position the reservoir, but hydration system 200 may alternatively be formed with neither or only one of these overlapping portions, such as with a support portion that does not overlap with region 224, without a handle portion that extends outside of the pack, or without a wrench assembly.

As discussed, however, the hanger assembly also may be used to retain the reservoir in a desired position relative to the pack, and it is within the scope of the invention that this positioning of the reservoir may be implemented by either or both of these mechanisms, that the hydration system includes a different positioning mechanism, or that the system is formed without a mechanism for retaining the reservoir in a selected position within the pack.

Figure 26:
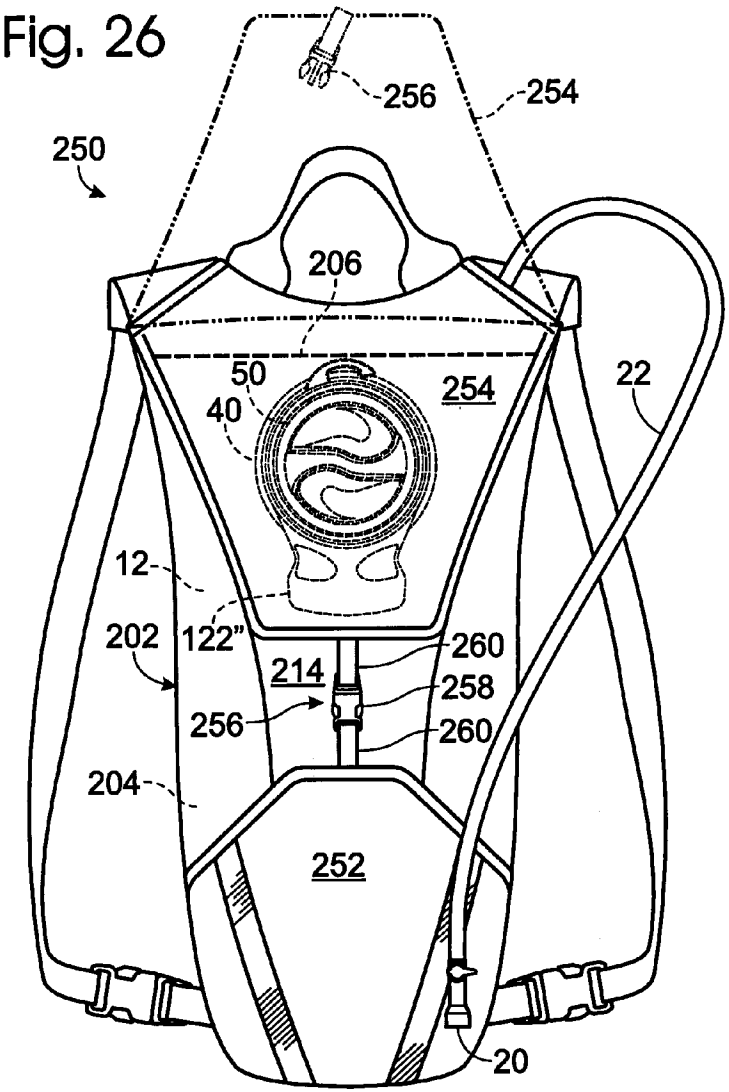
FIG. 26 is a top plan view of the personal hydration system of FIG. 22, showing another suitable pack configuration.

In FIG. 26, another personal hydration system constructed according to the present invention is shown and generally indicated at 250. Unless otherwise specified, system 250 may be formed with the same elements, subelements and/or variations as the other hydration systems described, illustrated and/or incorporated herein. For example, system 250 includes a reservoir 12, a mouthpiece 20, a flexible drink tube, or hose, 22, a fill port 40, and a filler cap assembly 50. System 250 is shown also including a wrench assembly 122", but it should be understood that system 250 may be formed without a wrench assembly. Similarly, it should be understood that the other hydration systems described, illustrated and/or incorporated herein may be formed with the elements, subelements and variations described in connection with system 250.

Figure 27:
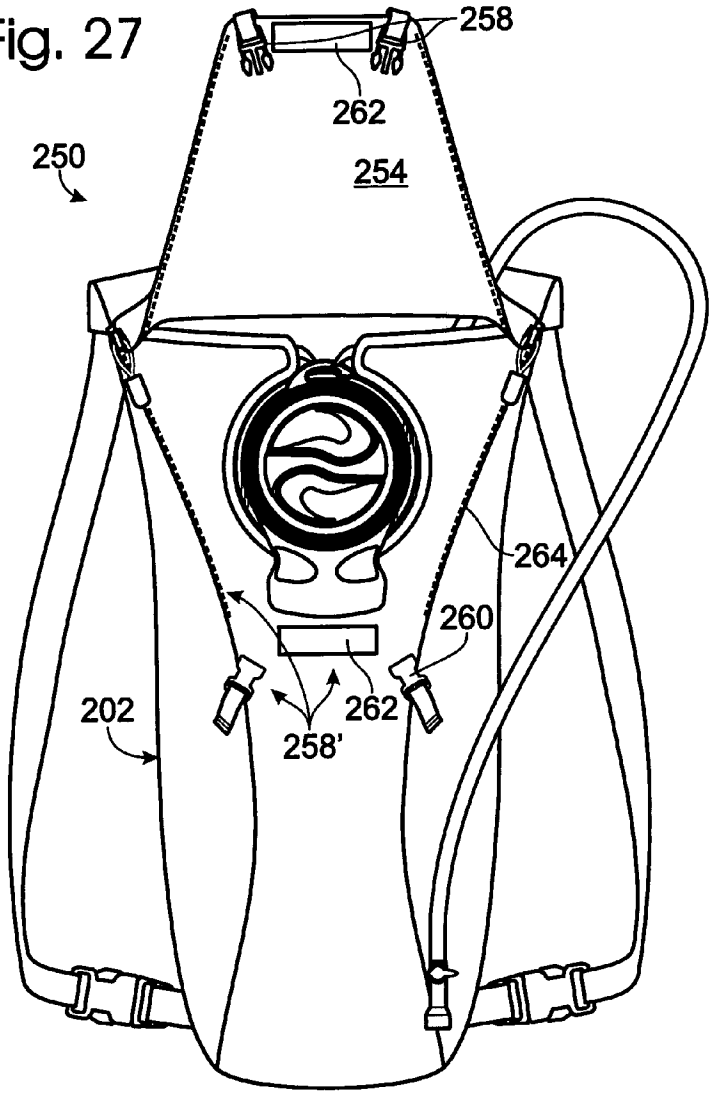
FIG. 27 is a top plan view of the personal hydration system of FIG. 22, showing another suitable pack configuration.

Similar to the hydration system shown in FIG. 22, system 250 includes a pack 202 with an internal compartment 204 in which reservoir 12 is received. System 250 further includes a pocket 252 that extends from outer surface 214 of the pack. Also shown in FIG. 26 is a cover, or dust shield 254 that covers fill port 40, filler cap assembly 50, and opening 206. Cover 254 preferably includes a releasable fastening mechanism 256 that selectively retains the cover over the fill port. For purposes of illustration, a releasable fastening mechanism 256 in the form of a clip 258 is shown. In FIG. 25, the fastening mechanism interconnects the cover with pocket 252 via a strap assembly 260. However, it is within the scope of the invention that one or more fastening mechanisms 256 may be used to secure the cover to surface 214, such as shown in FIG. 27. In FIG. 27, a variety of releasable fastening mechanisms are shown for purposes of illustration. It should be understood that one or more of the illustrated mechanisms may be used, or that other types of fastening mechanisms may be used. Illustrated in FIG. 27 are clips 258, hook and loop fasteners 262, and zippers 264. Other examples include buttons, snaps, clasps and ties.

INDUSTRIAL APPLICABILITY

The invented hydration systems are applicable to the hydration industry, and are specifically applicable to personal hydration systems, such as those worn by users in a variety of sporting, recreational, hunting, industrial, military and law enforcement applications.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

We claim:

1. A personal hydration system, comprising:

a flexible reservoir adapted to be received into a body-mountable pack and having a body portion with an internal compartment adapted to receive drink fluid, wherein the reservoir includes an exit port and a fill port, and further wherein the fill port includes a neck having an opening through which drink fluid may be added to and removed from the compartment;

a removable cap adapted to selectively seal the opening of the neck;

a wrench assembly extending around the neck, wherein the wrench assembly includes a handle projecting generally away from the neck, wherein the cap is adapted to be removed from the neck by rotation of the cap in a first direction, and further wherein the wrench assembly is coupled to the neck such that the wrench assembly is retained against rotation relative to the neck, thereby providing a counter lever to assist in the removal of the cap from the neck and the attachment of the cap onto the neck to form a seal therewith;

an elongate drink tube coupled to the exit port of the reservoir and adapted to receive drink fluid therefrom; and a self-sealing mouthpiece adapted to selectively dispense drink fluid from the drink tube to a user, wherein the mouthpiece is selectively configured between a closed position, in which the mouthpiece is adapted to prevent drink fluid from being dispensed therethrough, and a dispensing position, in which the mouthpiece is adapted to permit drink fluid to be dispensed therethrough, wherein the mouthpiece is adapted to be configured from the closed position to the dispensing position responsive to compressive forces applied thereto, and further wherein the mouthpiece is biased to automatically return from the dispensing position to the closed position.

2. The system of claim 1, wherein the wrench assembly is removably coupled to the fill port.

3. The system of claim 1, further comprising at least one fastening mechanism adapted to removably couple the wrench assembly to the fill port.

4. The system of claim 3, wherein the fastening mechanism includes a plurality of projections on a first one of the wrench assembly and the fill port, and a plurality of slots on a second one of the wrench assembly and the fill port, wherein the plurality of projections are adapted to be received into the plurality of slots.

5. The system of claim 4, wherein the plurality of projections include a plurality of radially spaced apart teeth extending from the wrench assembly toward the neck.

6. The system of claim 3, wherein the wrench assembly includes a plurality of projections extending generally toward the neck and adapted to be snap fit into at least one groove on the fill port.

7. The system of claim 3, further comprising a lock mechanism adapted to secure the wrench assembly around the neck.

8. The system of claim 3, wherein the wrench assembly is selectively positionable in a plurality of orientations around the neck.

9. The system of claim 3, wherein the wrench assembly is permanently attached to the fill port.

10. The system of claim 9, wherein the wrench assembly is integrally formed with the fill port.

11. The system of claim 9, wherein the wrench assembly is separately formed from the fill port and thereafter permanently coupled thereto.

12. The system of claim 1, wherein the wrench assembly is non-rotatably coupled to the fill port.

13. The system of claim 1, wherein the wrench assembly is selectively rotatable relative to the neck in a range of positions.

14. The system of claim 13, wherein the wrench assembly is selectively rotatable relative to the neck in a limited range of spaced-apart positions.

15. The system of claim 1, wherein the wrench assembly includes a support member that extends around the fill port.

16. The system of claim 1, wherein the opening has a diameter of at least 2.5 inches.

17. The system of claim 1, wherein the opening has a diameter in the range of 3 and 5 inches.

18. The system of claim 1, wherein the opening has an area of at least 5 square inches.

19. The system of claim 1, further including a pack with a pack compartment sized to receive the reservoir and a strap assembly adapted to secure the pack on a user's body.

20. The system of claim 19, wherein the pack compartment includes an outer surface with an opening through which the neck extends when the body of the reservoir is received within the pack compartment.

21. The system of claim 20, wherein at least a portion of the handle of the wrench assembly extends outside of the pack compartment when the body of the reservoir is received within the pack compartment.

22. The system of claim 1, further comprising a manually actuated on/off valve intermediate the mouthpiece and the reservoir and adapted to selectively prevent drink fluid from being dispensed through the mouthpiece, wherein the on/off valve is selectively configured between a closed configuration, in which drink fluid is prevented from being dispensed through the mouthpiece regardless of the position of the mouthpiece, and an open configuration, in which drink fluid may flow through the drink tube to the mouthpiece and be selectively dispensed therefrom.

23. The system of claim 1, wherein the cap includes a plug portion adapted to extend into the opening of the neck.

24. The system of claim 23, wherein the neck includes internally extending threads, and the plug portion includes externally extending threads that are adapted to engage the threads on the neck to secure the cap on the neck.

25. The system of claim 23, wherein the neck includes externally extending threads, and the plug portion includes internally extending threads that are adapted to engage the threads on the neck to secure the cap on the neck.

26. The system of claim 23, wherein the cap further includes at least one recess extending into the plug portion proximate the handle.

27. The system of claim 1, wherein the cap includes at least a pair of recesses that extend into the neck and a handle portion that extends generally between the at least a pair of recesses.

28. The system of claim 1, further including a tether adapted to couple the cap to the fill port, and further wherein at least a portion of the tether extends into the compartment of the reservoir when the cap is sealingly engaged with the neck.

29. A personal hydration system, comprising:

a flexible reservoir adapted to be received into a body-mountable pack and having a body portion with an internal compartment adapted to receive drink fluid, wherein the reservoir includes an exit port and a fill port, wherein the fill port includes a neck with externally extending threads, wherein the fill port includes a plurality of catches, and further wherein the neck includes an opening with an internal perimeter of at least 5 square inches through which drink fluid may be added to and removed from the compartment;

a removable cap adapted to selectively seal the opening of the neck, wherein the cap includes internally extending threads that are adapted to engage the externally extending threads of the neck to couple the cap onto the neck and form a seal therewith;

a wrench assembly extending around the neck, wherein the wrench assembly includes a plurality of projections extending generally toward the neck and adapted to be received into the catches, wherein the wrench assembly includes a handle projecting generally away from the neck, wherein the cap is adapted to be removed from the neck by rotation of the cap in a first direction, and further wherein the wrench assembly is coupled to the neck such that the wrench assembly is retained against rotation relative to the neck, thereby providing a counter lever to assist in the removal of the cap from the neck and the attachment of the cap onto the neck to form a seal therewith;

an elongate drink tube coupled to the exit port of the reservoir and adapted to receive drink fluid therefrom; and a self-sealing mouthpiece adapted to selectively dispense drink fluid from the drink tube to a user, wherein the mouthpiece is selectively configured between a closed position, in which the mouthpiece is adapted to prevent drink fluid from being dispensed therethrough, and a dispensing position, in which the mouthpiece is adapted to permit drink fluid to be dispensed therethrough, wherein the mouthpiece is adapted to be configured from the closed position to the dispensing position responsive to compressive forces applied thereto, and further wherein the mouthpiece is biased to automatically return from the dispensing position to the closed position.

30. The system of claim 29, wherein the wrench assembly is removably coupled to the fill port.

31. The system of claim 29, wherein the wrench assembly is rotatably coupled to the fill port.

32. The system of claim 29, wherein the wrench assembly is non-rotatably coupled to the fill port.

33. The system of claim 29, wherein the wrench assembly is fixedly secured to the fill port.

34. The system of claim 29, further comprising a lock mechanism adapted to selectively prevent the wrench assembly from rotating relative to the neck.

35. The system of claim 29, wherein the wrench assembly includes a support member extending around the neck.

36. A personal hydration system, comprising:

a flexible reservoir adapted to be received into a body-mountable pack and having a body portion with an internal compartment adapted to receive drink fluid, wherein the reservoir includes an exit port and a fill port, and further wherein the fill port includes a neck having an opening through which drink fluid may be added to and removed from the compartment, wherein the opening has a cross-sectional area of at least 5 square inches;

a removable cap adapted to selectively seal the opening of the neck;

a wrench assembly extending around the neck, wherein the wrench assembly includes a handle projecting generally away from the neck, wherein the wrench assembly is coupled to the neck such that the wrench assembly is retained against rotation relative to the neck;

an elongate drink tube coupled to the exit port of the reservoir and adapted to receive drink fluid therefrom; and a self-sealing mouthpiece adapted to selectively dispense drink fluid from the drink tube to a user, wherein the mouthpiece is selectively configured between a closed position, in which the mouthpiece is adapted to prevent drink fluid from being dispensed therethrough, and a dispensing position, in which the mouthpiece is adapted to permit drink fluid to be dispensed therethrough, wherein the mouthpiece is adapted to be configured from the closed position to the dispensing position responsive to compressive forces applied thereto, and further wherein the mouthpiece is biased to automatically return from the dispensing position to the closed position.

37. The system of claim 36, wherein the wrench assembly is removably coupled to the fill port.

38. The system of claim 36, further comprising at least one fastening mechanism adapted to removably couple the wrench assembly to the fill port.

39. The system of claim 38, wherein the fastening mechanism includes a plurality of projections on a first one of the wrench assembly and the fill port, and a plurality of slots on a second one of the wrench assembly and the fill port, wherein the plurality of projections are adapted to be received into the plurality of slots.

40. The system of claim 39, wherein the plurality of projections include a plurality of radially spaced apart teeth extending from the wrench assembly toward the neck.

41. The system of claim 39, wherein the wrench assembly includes a plurality of projections extending generally toward the neck and adapted to be snap fit into at least one groove on the fill port.

42. The system of claim 36, further comprising a lock mechanism adapted to secure the wrench assembly around the neck.

43. The system of claim 36, wherein the wrench assembly is selectively positionable in a plurality of orientations around the neck.

44. The system of claim 36, wherein the wrench assembly is permanently attached to the fill port.

45. The system of claim 36, wherein the wrench assembly is non-rotatably coupled to the fill port.

46. The system of claim 36, wherein the wrench assembly is selectively rotatable relative to the neck in a limited range of spaced-apart positions.

47. The system of claim 36, wherein the wrench assembly includes a support member that extends around the fill port.

48. The system of claim 36, wherein the opening has a diameter in the range of 3 and 5 inches.

49. The system of claim 36, further including a pack with a pack compartment sized to receive the reservoir and a strap assembly adapted to secure the pack on a user's body.

50. The system of claim 49, wherein the pack compartment includes an outer surface with an opening through which the neck extends when the body of the reservoir is received within the pack compartment.

51. The system of claim 50, wherein at least a portion of the handle of the wrench assembly extends outside of the pack compartment when the body of the reservoir is received within the pack compartment.

52. The system of claim 36, further comprising a manually actuated on/off valve intermediate the mouthpiece and the reservoir and adapted to selectively prevent drink fluid from being dispensed through the mouthpiece, wherein the on/off valve is selectively configured between a closed configuration, in which drink fluid is prevented from being dispensed through the mouthpiece regardless of the position of the mouthpiece, and an open configuration, in which drink fluid may flow through the drink tube to the mouthpiece and be selectively dispensed therefrom.

* * * * *